United States Patent [19]

Douglas

[11] Patent Number: 4,463,976

[45] Date of Patent: Aug. 7, 1984

[54] CASEMENT WINDOWS

[75] Inventor: Jack E. Douglas, Walsall, England

[73] Assignee: Arthur Shaw Manufacturing Limited, West Midlands, England

[21] Appl. No.: 440,033

[22] Filed: Nov. 8, 1982

[30] Foreign Application Priority Data

Nov. 20, 1981 [GB] United Kingdom ..... 8135022

[51] Int. Cl.[3] ..... E05C 3/04

[52] U.S. Cl. ..... 292/202; 292/244; 292/DIG. 33

[58] Field of Search ..... 292/202, 204, 207, 209, 292/194, 262, 240, 241, 268, 242, 244, 246, 248, 249, 250, DIG. 33

[56] References Cited

U.S. PATENT DOCUMENTS

| | | | |
|---|---|---|---|
| 1,943,946 | 1/1934 | Brainerd | 292/244 X |
| 3,458,226 | 7/1969 | Carlston | 292/268 |
| 3,907,344 | 9/1975 | Newlon et al. | 292/244 X |

FOREIGN PATENT DOCUMENTS

| | | | |
|---|---|---|---|
| 90603 | 10/1937 | Sweden | 292/241 |

*Primary Examiner*—Richard E. Moore

*Attorney, Agent, or Firm*—Larson and Taylor

[57] ABSTRACT

In a casement window, the casement fastener comprises a pivotal lever handle 5 mounted on the sash 2 through a plate 7 and a keeper 6 mounted on the casement frame 1. The keeper 6 has two similar lugs 14,15 symmetrically disposed lengthwise of the keeper plate 11. The lever handle 5 has an abutment face 10 to engage either lug 14,15 for fastening the sash, and a through slot 9 in which either lug 14,15 may be received to hold the sash in a ventilating position. The fastener may be used for right or left hinged sashes, and by the special form of keeper and handle, the fastener can be used for any required attitude of installation without concern for specially handed keepers or lever handles.

5 Claims, 3 Drawing Figures

CASEMENT WINDOWS

BACKGROUND OF THE INVENTION

1. Field of the Invention

This invention concerns improvements in fasteners for casement windows of the kind comprising a glazed sash mounted on a frame by a hinge for pivotal movement relative to the frame about a hinge axis extending parallel to one side member of the frame. Such casement windows are hereinafter called of the kind specified.

In the traditional manufacture of casement windows of the kind specified, the sash and frame are made of timber and the sash is mounted on the frame by suitable hinges. The casement window is supplied to the building trade or other customer without any window hardware, such as the fastener and/or stay, and the hardware is fitted later on installation and glazing of the casement window. The hardware is selected to suit the handing or hinge position of the sash.

As will be understood, the range of joinery required to hold stock of all types, sizes and arrangements of sashes is extensive. The frame may include one or more pivotal sashes and provide for fixed lights. The sashes may be hinged for side opening to the left or right, or be top hung such as for an awning or ventilator, or be bottom hung such as for a fanlight or ventilator. Combinations of such sashes may be provided in a one frame.

2. Description of the Prior Art

A typical type of fastener used for such casement windows is a lever handle having a co-operating keeper with the lever handle being mounted on the sash and the keeper mounted on the frame. The typical lever handle casement fastener is single-handed and special handed sets or parts for alternate handing have to be provided.

For the foregoing reasons, not only is there a substantial stock-holding requirement for styles of casement windows, but also a range of the window hardware, particularly lever handle casement fasteners, has to be provided to accommodate customer requirements for different handing of the sashes. Substantial costs thereby accrue in and to the trade.

Recent trends in mass producing joinery and the use of non-timber materials such as metal and plastics have led to further problems. With the mass production of casement windows of modular or system design, it is desirable to provide a standard range of frames and sashes so that from such modular parts, a wide range of styles of casement windows can be assembled with the sash or sashes being hingedly mounted as desired.

Another desiderata for the joinery manufacturer is to provide the window hardware prefitted to the sash or frame, particularly where such fitting cannot be completed by unskilled persons or without special tools, such as is the case with plastics or metal sections. This desiderata is enhanced by the further trend of factory glazing sashes with sealed units, and after glazing the sash, it is undesirable to risk on site fixing of the casement fastener handle to the sash section.

Whilst it is possible to provide special window hardware of a complex kind such as assemblies for fastening with integrated hinge means, these fittings are expensive, increasing the cost of manufacture and price on resale. Furthermore, many eventual users wish to preserve a traditional look or style in new or replacement windows.

Accordingly, it is an object of this invention to provide in a casement window of the kind specified, an improved casement fastener of the lever handle type which is non-handed.

Other objects and merits of this invention will be explained later herein.

SUMMARY OF THE INVENTION

According to this invention, we provide in a casement window of the kind specified, a fastener comprising a lever handle mounted on a plate for pivotal movement from an intermediate release position to one of first and second securing positions spaced relatively by 180°, the handle mounting plate being secured to the hinged sash of the casement window for engagement with a keeper mounted on the adjacent casement frame, the keeper comprising a base plate having similar first and second spaced apart lugs projecting therefrom, each lug being arranged for engagement by an abutment face of the lever when the lever is in a respective one of the two securing positions with said abutment face being spaced from the pivot axis of the lever handle, the arrangement being such that in use the lever handle may be moved from the released intermediate position when it clears the space intermediate the first and second lugs of the keeper to one of the first and second securing positions engaging respectively either the first or second lug to secure the sash to the frame.

By this invention, the lever handle may be brought into the securing position by turning in either sense from the intermediate release position to one of the first or second securing positions. Whichever way the lever handle is turned, it will engage one of the two lugs. Thus the lever handle can be mounted on a sash, and on hanging the sash on a frame and fixing the keeper to the frame, the handle is operable to secure the sash to the frame with a movement in either direction and is not restricted to any handing. For example, if the sash were mounted for left handed opening, the normal direction of securing movement of the handle would be downwards, and this would be to move the handle from the intermediate position to the first securing position engaging with the first lug of the adjacent keeper. If the sash were required to be used with a frame hung for right hand opening, then the sash can be turned through 180° in the plane of the sash, and the lever handle would be employed again in the downward direction to engage a keeper on the frame, but the handle would be moved from the intermediate release position to the second securing position. Due to the symmetry of the keeper with the two lugs, this also can be used on any selected side of the frame to engage the lever handle.

Thus, by this invention, it is not necessary to provide a range of handles and keepers for opposite handing requirements, and a single handle can be mounted on the sash for use in all modes of hinged mounting on the frame. Furthermore, by the provision of the special keeper, only a single type of keeper is required. This provides substantial economies and advantages.

The lever handle may be mounted on the sash by the joinery manufacturer, and where the window system provides for selection of the hinge position, the keeper can be fitted to the frame at the required aligned position following the assembly of the sash to the frame. The base plate of the keeper may be arranged to be symmetrical with respect to the two lugs.

This simple arrangement of the lever handle and a keeper with two lugs and the symmetry thereof provides a very cheap and advantageous solution to the problems as afore-discussed. Additionally, by such arrangement, the style and design of the lever handle and the outward appearance of the casement fastener may be retained or designed to suit the customer, and the user has no difficulty in operating the fastener, even on a new window system.

Conveniently, the lever handle is provided with a through slot or recess in the handle extending substantially parallel to the said abutment face, and the first or second lugs may be received in the slot to keep the sash displaced outwardly from the casement frame in a ventilating position.

In many of the systems for windows permitting alternate or selected hinging of the sash, it is not possible to provide a ventilating position of the sash.

Preferably, the keeper plate has an elongate substantially flat base plate of which the underside face may be chamfered or contoured to suit the profile of the casement frame. The mounting plate of the lever handle may be provided with apertures or holes for mounting the handle on the sash. The apertures or holes may be designed to lie underneath or be masked by the lugs of the keeper when the casement fastener handle engages the first or second lug of the keeper.

Other features of this invention will be understood from the exemplary embodiment shown in the accompanying drawings.

DETAILED DESCRIPTION OF THE EMBODIMENT

Figure 1:
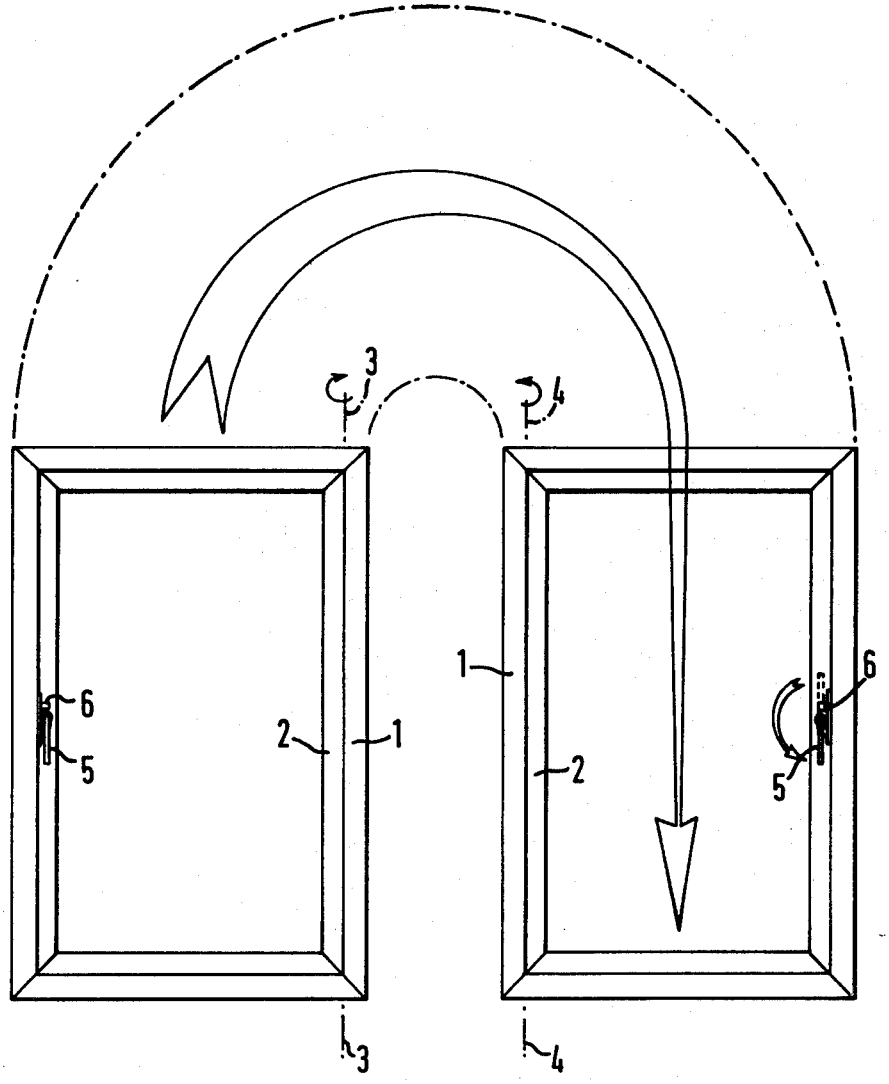
FIG. 1 is schematic view of a casement window of the kind specified having a casement fastener according to this invention and the view depicts the reversal of the hinged side of the sash.

With reference to the drawings, a casement window of the kind specified comprises a fixed frame 1 and a sash 2. As shown in FIG. 1 the sash may be hingedly mounted on the frame 1 about a right-hand axis 3 or a left-hand axis 4 so that the same sash may be used for respective left or right side openings on the same frame. The hinges used may be of any suitable kind and are not relevant to this invention.

To secure the sash to the frame, there is provided a casement fastener comprising a lever handle 5 and a keeper 6. The lever handle is mounted on a plate 7 fixed to the sash member on the side opposed to the hinge axis. The lever handle 5 is mounted for pivotal movement relative to the plate 7 on a pivot pin or axle (not shown) concealed within or extending from a boss 8. The lever handle can be turned through at least 180° so as to extend lengthwise of the sash member in opposed directions from the pivot pin or axle as shown in the right hand view of FIG. 1.

The lever handle has a through slot 9 extending through the handle section adjacent to the pivot axis but spaced therefrom, and aligned with the slot and substantially parallel thereto, the lever handle has an abutment face 10.

The keeper 6 comprises a base plate 11 having holes 12 adjacent each end for receiving fastening elements 13 for fixing the keeper 6 to the frame 1. The base plate is substantially flat but the underside face may be flat or tapered or otherwise profiled or shaped to suit the profile of the frame 1. Upstanding from the base plate 11 and integral therewith are two lugs 14, 15 which are aligned lengthwise of the plate and spaced apart. The lugs are similar and disposed symmetrically with respect to the base plate.

Figure 2:
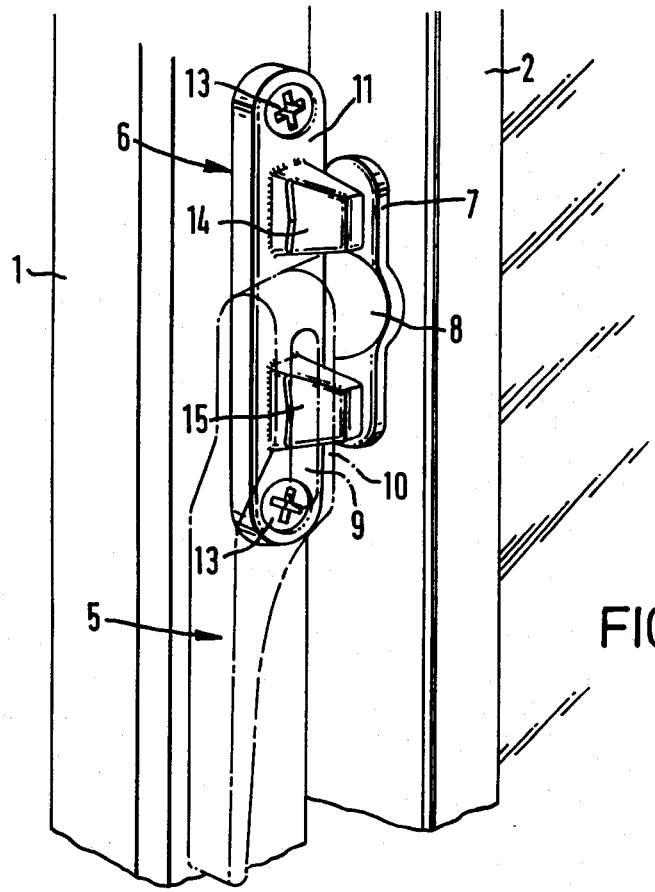
FIG. 2 is an isometric view of part of the sash and part of the casement frame illustrating the lever handle casement fastener engaging the keeper to maintain the sash in a partly open ventilating position.

Each lug is designed to be received within the slot 9 as shown in FIG. 2, and in such securing position of the handle, the sash is held out slightly from the frame 1 for a ventilating position of the sash. Each lug is also arranged to abut against the abutment face 10 on the underside of the lever handle when the handle is in such securing position so that the fastener holds the sash in the closed position tight up against the frame. For this tight engagement on closure of the sash, the face of the lug engaged by the abutment face of the lever handle may taper to provide a wedging action. The spacing of the two lugs is such as to permit the boss of the lever handle to extend between the two lugs with clearance. When the handle is in the intermediate position extending transversely to the length of the mounting plate, there is no interference for movement of the handle between the lugs.

As will be appreciated, when lever handle is arranged to be moved from the securing position as shown in FIG. 2 into a release position, on turning the handle through about 90°, the handle is disengaged from the lug, and when the handle is clear of the lug, the sash can be opened. To close the sash, the handle is presented in the intermediate position transverse to the sash member, and then can be swung downwards to engage the lug. If desired, the lever handle could be swung upwards to engage the other lug of the keeper.

Figure 3:
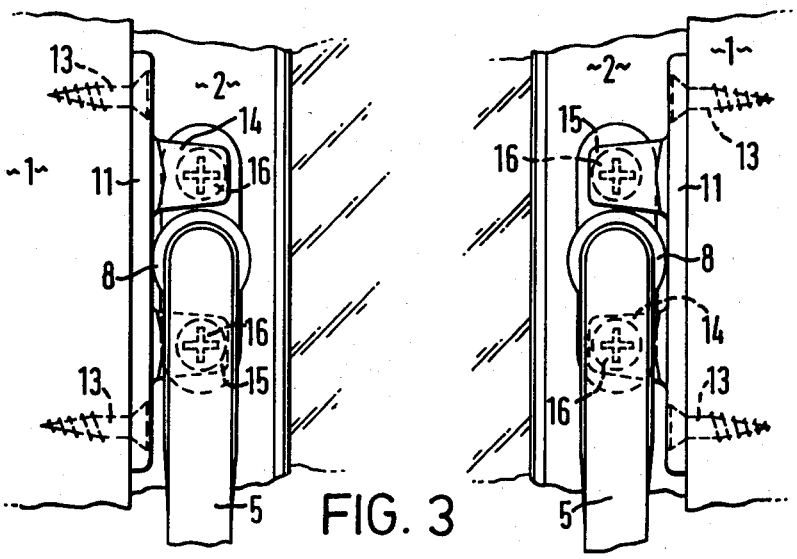
FIG. 3 is two side views of the casement fastener and keeper in the respective two opposed positions showing the arrangement on opposite handing of the sash.

Let it now be assumed that the lever handle of the casement fastener is mounted on a sash for left handed opening such as shown in FIG. 2 and depicted schematically on the left of FIGS. 1 and 3. The frame is fixed or is of a design including cill and head sections so that it cannot be moved or reversed, but it is desired to hinge the sash on the left hand side for right hand opening. As shown in FIG. 1, the sash can be turned through 180° in the vertical plane still having the lever handle mounted thereon. The keeper is mounted on the other side of the frame, and all that is required is to turn the lever handle for downwards fastening movement to present this in the conventional attitude for use.

In the exemplary embodiment shown, the fastenings for the mounting plate of the lever handle are provided by screws 16 fixing into the sash member, and by disposing these in register with the two lugs of the keeper, the heads of the screws or like fixings are masked when the sash is closed. Accordingly, by such an arrangement, once the fastener is closed, it is not possible to see such fixings and tampering therewith is precluded.

The mounting plate of the lever handle and the base plate of the keeper may be designed to suit the style and profile of the casement window, and where the material of the casement window is of hollow section, such as metal or plastics, special secret fixings may be employed.

In some designs of casement windows where the sashes are provided with the lever handle mounted thereon, suitable registration marks may be provided on the frame to provide location and registration of the keeper at the required aligned position.

The lever handle may be of any required design or length or shape to suit the style required, and preferably the lever handle is a die casting or plastic moulding of suitable strength. The keeper may also be a die-casting or plastics moulding.

As will be appreciated, although the foregoing description has only shown the invention being applied to changing the sash from left hand to right hand hinged movement, the same principle is applied for a change from top to bottom hinged movement.

I claim:

1. In a casement window having a glazed sash mounted on a frame for relative movement by a hinge, a fastener comprising a lever handle mounted on a plate for pivotal movement from an intermediate release position to one of first and second securing positions spaced relatively by 180°, said handle mounting plate being secured to the hinged sash of the casement window for engagement with a keeper mounted on the adjacent casement frame, said keeper comprising a base plate having similar first and second spaced apart lugs projecting therefrom, each said lug being arranged for engagement by an abutment face of said lever when said lever is in a respective one of the said two securing positions with said abutment face being spaced from the pivot axis of said lever handle, whereby said lever handle may be moved from the released intermediate position when it clears the space intermediate said first and second lugs of the keeper to one of said first and second securing positions engaging respectively either said first or second lug to secure said sash to said frame.

2. A fastener according to claim 1 wherein said lever handle is provided with a through slot or recess extending substantially parallel to the said abutment face, and said first or second lugs may be received in said slot or recess to keep said sash displaced outwardly from said frame in a ventilating position.

3. A fastener according to claim 2 wherein said keeper base plate is elongate and substantially flat and has an underside face which is chamfered or profiled to complement the profile of said casement frame.

4. A fastener according to claim 1 wherein said mounting plate for said lever handle includes holes receiving fasteners securing said plate to said sash, and said holes being located so that when the fastener is in either said first or second securing positions, said lugs on said keeper overlie said holes and fasteners therein.

5. A fastener according to claim 4 wherein said similar first and second lugs are symmetrically disposed on said keeper base plate, and the face of each said lug engageable by the said abutment face of said lever handle is inclined to provide a wedging action on engagement by the said abutment face.

* * * * *